US005632625A

United States Patent [19]

Faust

[11] Patent Number: 5,632,625

[45] Date of Patent: May 27, 1997

[54] ROTARY ELECTRICAL COUPLING WITH CIRCUMFERENTIAL CONDUCTIVE ELASTOMER BRUSH

[75] Inventor: Hein-Peter Faust, North Vancouver, Canada

[73] Assignee: Apollo Machinery, Ltd., North Vancouver, Canada

[21] Appl. No.: 451,303

[22] Filed: May 26, 1995

[51] Int. Cl.[6] ..... H01R 39/00

[52] U.S. Cl. ..... 439/24; 439/199

[58] Field of Search ..... 439/18, 20, 23, 439/24, 25, 26, 86, 198, 199, 201, 668, 669

[56] References Cited

U.S. PATENT DOCUMENTS

| | | | |
|---|---|---|---|
| 3,193,636 | 7/1965 | Daniels | 439/20 |
| 3,701,965 | 10/1972 | DuRocher et al. | 439/86 |
| 3,742,427 | 6/1973 | Ballard | 439/199 |
| 4,583,798 | 4/1986 | Blazowich | 439/24 |
| 4,684,180 | 8/1987 | Bigham et al. | 439/29 |
| 4,773,866 | 9/1988 | Basques | 439/26 |
| 4,934,367 | 6/1990 | Daglow et al. | 439/86 |
| 5,289,882 | 3/1994 | Moore | 439/198 |

FOREIGN PATENT DOCUMENTS

| | | |
|---|---|---|
| 3110807 | 12/1982 | Germany . |
| 44 14950 | 11/1994 | Germany . |

*Primary Examiner*—Neil Abrams
*Assistant Examiner*—Barry Matthew L. Standig
*Attorney, Agent, or Firm*—Oyen Wiggs Green & Mutala

[57] ABSTRACT

A coupling is described for conducting electrical signals between two members which are movably mounted to each other. The coupling uses a piece of compressed electrically conductive elastomer material to maintain physical and electrical contact between the two members. The coupling is well adapted for conveying low current analog or digital control signals. In a preferred form the coupling is a rotary coupling which has a drum mounted for rotation in a cavity in a housing. The outer surface of the drum and the inner surface of the cavity each have a number of circumferential electrically conductive rings aligned in pairs. A ring of electrically conductive elastomer material is compressed between each pair of rings. The coupling can be advantageously combined with a rotary coupling for hydraulic fluid. In the combined electric-hydraulic rotary coupling the electric portion of the coupling is flushed with hydraulic fluid. The rotary electrical coupling is rugged, completely sealed and is electrically quiet during rotation.

14 Claims, 3 Drawing Sheets

ROTARY ELECTRICAL COUPLING WITH CIRCUMFERENTIAL CONDUCTIVE ELASTOMER BRUSH

FIELD OF THE INVENTION

This invention relates to a coupling for conducting electrical signals between members which are movably mounted to each other. A particular embodiment of the invention pertains to a rotary electrical coupling. A more particular embodiment of the invention pertains to a combined electrical-hydraulic rotary coupling.

BACKGROUND OF THE INVENTION

In making machinery it is sometimes necessary or desirable to conduct electrical signals between two parts which move relative to each other. Rotary couplings are a common example. For example, some kinds of heavy equipment, such as logging grapples, have a working head which is mounted to the rest of the machine with a rotary joint. The working head typically includes several independent hydraulic circuits which are powered from a hydraulic pump in the body of the machine. It is desirable to control these hydraulic circuits with electrically operated valves mounted in the working head. However, there has been no completely satisfactory means for transmitting electrical control signals through a rotary coupling to the working head of a heavy machine.

In previous heavy machines, each hydraulic circuit has been controlled by valves mounted in the body of the machine. Separate hydraulic lines were then run to and from each hydraulic circuit. This construction generally requires a rotary hydraulic coupler which has two separate fluid connections for each hydraulic circuit. Such rotary hydraulic connectors are expensive to purchase and maintain and are also inconveniently long for many applications. Rotary hydraulic connectors which have many separate hydraulic lines passing through them have a large number of internal seals. If any one seal fails then the entire unit must be serviced.

Where the hydraulic circuits in the working head of a machine are operated by electrically controlled valves in the working head only two hydraulic lines, a pressure line and a return line, are needed. This reduces the cost, size and complexity of the rotary hydraulic coupling. In addition to the hydraulic lines it is necessary to provide electrical power for energizing the electrically controlled valves and signals for controlling the valves in response to commands from the machine's operator. Thus, a rotary electrical coupling is also required.

Most previous rotary electrical couplings comprise a cylindrical drum with several electrically conductive rings extending around its cylindrical outer surface at axially spaced positions. One or more brushes made of graphite, or a similar material, are held in contact with each conductive ring by a spring. The brushes maintain electrical contact with the conductive rings on the drum as the drum rotates.

These previous electrical couplings have several significant disadvantages. The quality of the contact between the brushes and the conductive rings can vary as the drum turns. This can introduce noise into electrical control signals being transmitted through the coupling. Electrical noise can also be introduced if the brushes move when the electrical coupling is subjected to mechanical impact. Electrical noise can prevent control signals from being reliably transmitted through the coupling. These problems can become worse over time. Dust is created as the brushes and conductive rings wear. The dust can interfere with contact between the brushes and the conductive rings and can also cause short circuits between adjacent conductive rings. If the electrical coupling is not extremely well sealed then dust and/or moisture may enter the coupling and make its operation even more unreliable.

These problems are especially severe in heavy equipment which is exposed to frequent mechanical shock and may be operated in very dusty or wet environments.

German patent application No. 4,414,950 discloses a rotary coupling which allows a fluid and electrical signals to be transmitted through the coupling. The coupling is designed primarily for use in painting equipment. The electrical portion of the coupling is sealed from the fluid carrying portion of the coupling.

SUMMARY OF THE INVENTION

This invention provides an electrical coupling between first and second members. The coupling comprises a conductive elastomer material compressed between a conductive pad on a surface of the first member and a conductive pad on a surface of the second member.

One embodiment of the invention provides a rotary electrical coupling. The coupling comprises: a housing; a rotatable member mounted within a chamber in the housing for rotation relative to the housing about an axis; an electrically conductive ring centered on the axis on an inner surface of the chamber; an electrically conductive member comprising a resilient elastomer material compressed between the member and an inner surface of the ring; a first electrical conductor on the housing and in electrical contact with the ring; and a second electrical conductor on the rotatable member and in electrical contact with the electrically conductive member.

In a preferred embodiment of the invention the rotary electrical coupling is combined with a rotary fluid coupling. Preferably, the rotary fluid coupling comprises a fluid inlet containing a pressurized electrically insulating lubricating fluid and a fluid outlet containing the electrically insulating lubricating fluid at a reduced pressure. The electrical rotary coupling comprises a first passage extending between the fluid inlet and the chamber and a second passage extending between the chamber and the fluid outlet.

BRIEF DESCRIPTION OF THE DRAWINGS

In drawings which illustrate specific embodiments of the invention, but which should not be construed as restricting the spirit or scope of the invention in any way.

DETAILED DESCRIPTION OF PREFERRED EMBODIMENTS OF THE INVENTION

Figure 1:
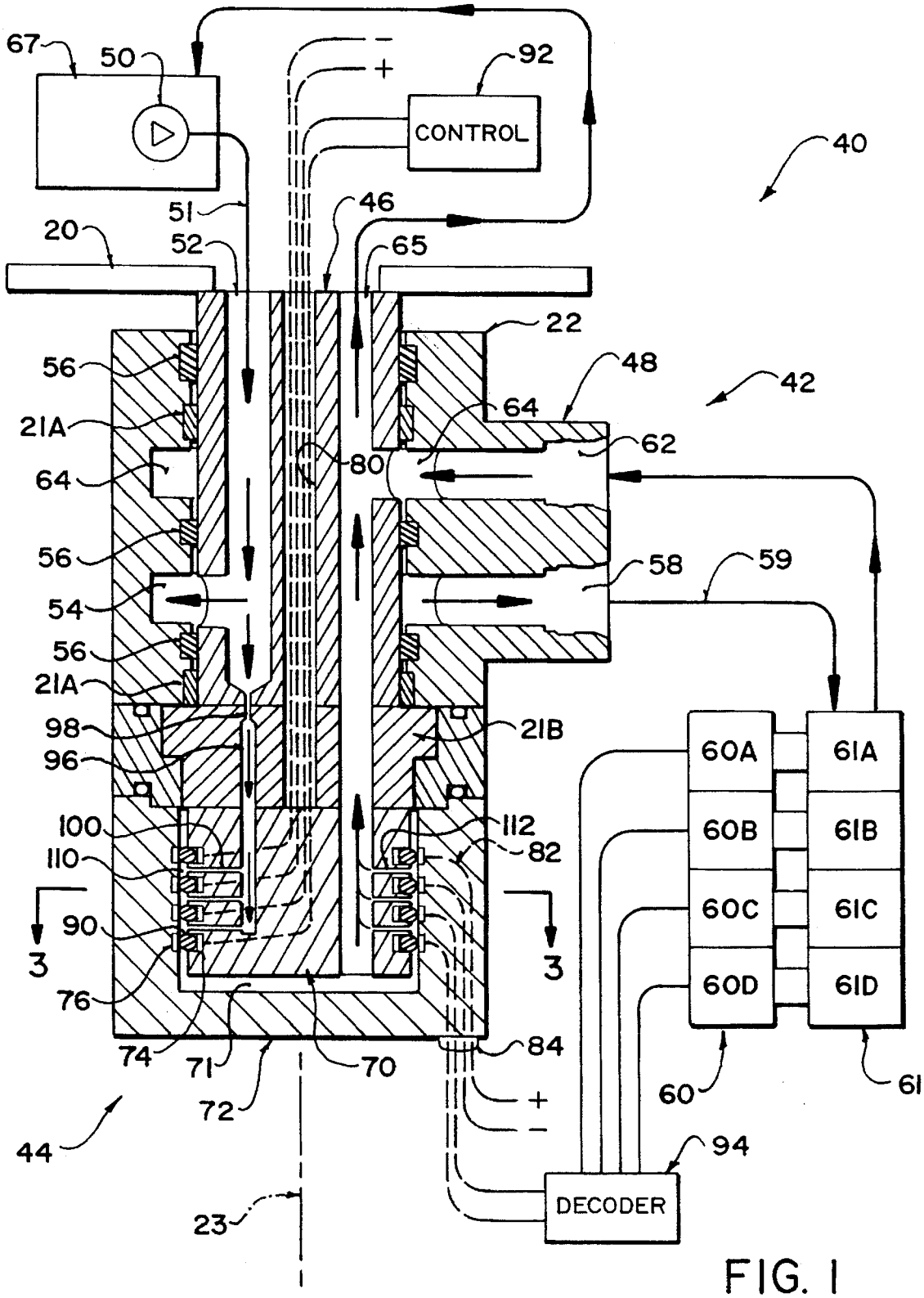
FIG. 1 is a partially schematic elevational section through a combined electric-hydraulic rotary coupling according to the invention.

FIG. 1 shows a combined electrical-hydraulic rotary coupling 40 according to the invention mounted between a fixed portion 20 and a rotary portion 22 of a machine by wear rings 21A and a thrust bearing 21B. Rotary portion 22 can be turned about an axis 23 relative to fixed portion 20 by any suitable means, such as a motor (not shown).

Electrical-hydraulic coupling 40 comprises a hydraulic portion 42 and an electrical portion 44. Hydraulic portion 42 has a cylindrical core 46 mounted to fixed portion 20 and a concentric cylindrical outer shell 48 and spaced outwardly from core 46. Outer shell 48 forms a part of rotating portion 22. Equipment which is desired to rotate with rotating portion 22 may be mounted to outer shell 48. A pump 50 pumps hydraulic fluid 51 into an inlet conduit 52 in core 46. Conduit 52 exits radially into an annular chamber 54 which is sealed by seals 56 between core 46 and outer shell 48. Fluid 51 flows from chamber 54 through an outlet 58 and a conduit 59 into a valve block 61. Fluid 51 returns from valve block 61, through an inlet 62 in shell 48, to an annular chamber 64 in hydraulic portion 42. From annular chamber 64 fluid 51 exits through conduit 65 in core 46 to reservoir 67.

Valve block 60 may be mounted directly to outer shell 48 with the inlet of valve block 60 directly connected to outlet 58 and the outlet of valve block 60 directly connected to inlet 62. This makes for a very compact system and eliminates the need for hoses or other conduits between valve block 61 and hydraulic portion 42.

Electrical portion 44 comprises a cylindrical drum 70 which is mounted concentrically in a cylindrical bore 71 in a housing 72. Drum 70 is mounted to core 46. Housing 72 is mounted to shell 48. As shell 48 is turned with respect to fixed portion 20 drum 70 turns inside housing 72. Electrically conductive rings 74 are spaced apart along the outer surface of drum 70. Corresponding electrically conductive rings 76 are spaced apart along the inner surface of bore 71. Electrical conductors 78 extend through a hole 80 in core 46 to rings 74. Electrical conductors 82 extend from rings 76 to a terminal block 84 on housing 72. The portions of drum 70 and housing 72 in contact with conductive rings 74 and 76 are made of electrically insulating material so that rings 74 are electrically isolated from each other as are rings 76.

Electrical contact between rings 74 and corresponding ones of rings 76 is maintained by electrically conductive elastomer o-rings 90 which extend around rings 74 and fill the space between rings 74 and rings 76. O-rings 90 sit in circumferential grooves in rings 74 and are slightly compressed between rings 74 and tings 76. O-rings 90 are made of an electrically conductive elastomer material and may be, for example, the o-rings available from the Parker Seal Group—O-ring division of Culver City, Calif. and identified as o-rings made from PAR SHIELD MATERIAL NO. S6450.

Drum 70 may be fabricated, for example, by making a core of a suitable material, such as Aluminum, placing the core and rings 74 in a mould with the core passing through but not touching rings 74, soldering electrical conductors 78 to rings 74, and filling the mould with an electrically insulating epoxy material 77 such as the Sealtronic™ epoxy encapsulate available from Industrial Formulators of Canada Limited of Burnaby, British Columbia, Canada.

Rings 76 may made by fabricating a tube having flanges projecting from it at the desired spacings for rings 76. Electrical conductors 82 are soldered to the flanges. The tube is then inserted into the outer shell of housing 72, which may be fabricated from aluminum, with conductors 82 routed as desired, and the space between the tube the outer shell of housing 72 is filled with a suitable electrically insulating epoxy 77, such as the Sealtronic™ epoxy mentioned above. After the epoxy has cured the tube is bored out until only rings 76 remain mounted in the epoxy.

Analog or digital electrical control signals may be transmitted through electrical coupling 44. In the embodiment of FIG. 1, the operator of the machine activates switches (not shown) which indicate to a control unit 92 which of individual hydraulic valves 61A, 61B, 61C and 61D in valve block 61 should be actuated. Control unit 92 then generates digital control signals which are sent through electrical coupler 44. The control signals pass through electrical coupler 44 to a decoder 94. Decoder 94 decodes the control signals and actuates appropriate ones of electrical actuators 60A, 60B, 60C and 60D in to control individual hydraulic valves 61A, 61B, 61C and 61D according to the machine operator's commands. Hydraulic lines (not shown) connect hydraulic valves 61A, 61B, 61C and 61D to hydraulic pistons, hydraulic motors and/or other hydraulically operated equipment (not shown) which is to be controlled by the machine operator.

O-rings 90 are lubricated by an electrically non-conductive lubricant. In the embodiment shown in FIGS. 1, 2 and 3 electrical portion 44 is lubricated and flushed by hydraulic fluid 51 from hydraulic portion 42. Hydraulic fluid 51 flows from inlet conduit 52 through a conduit 96 which extends into drum 70. An orifice 98 in conduit 52 limits the flow of hydraulic fluid 51 into drum 70. Hydraulic fluid 51 flows through apertures 100 out of conduit 96 into annular spaces 110 between o-rings 90. The hydraulic fluid then flows around annular spaces 110 until it reaches apertures 112 from where it flows through exit conduit 65 to tank 67.

The pressure of hydraulic fluid 51 within electrical portion 44 can be kept larger than the ambient pressure outside electrical portion 44. This makes it possible for electrical portion 44 to function in high pressure environments, such as in downhole applications in oil fields. The pressure of hydraulic fluid inside electrical portion 44 prevents fluid, dirt or moisture from entering electrical portion 44 from outside.

Figure 2:
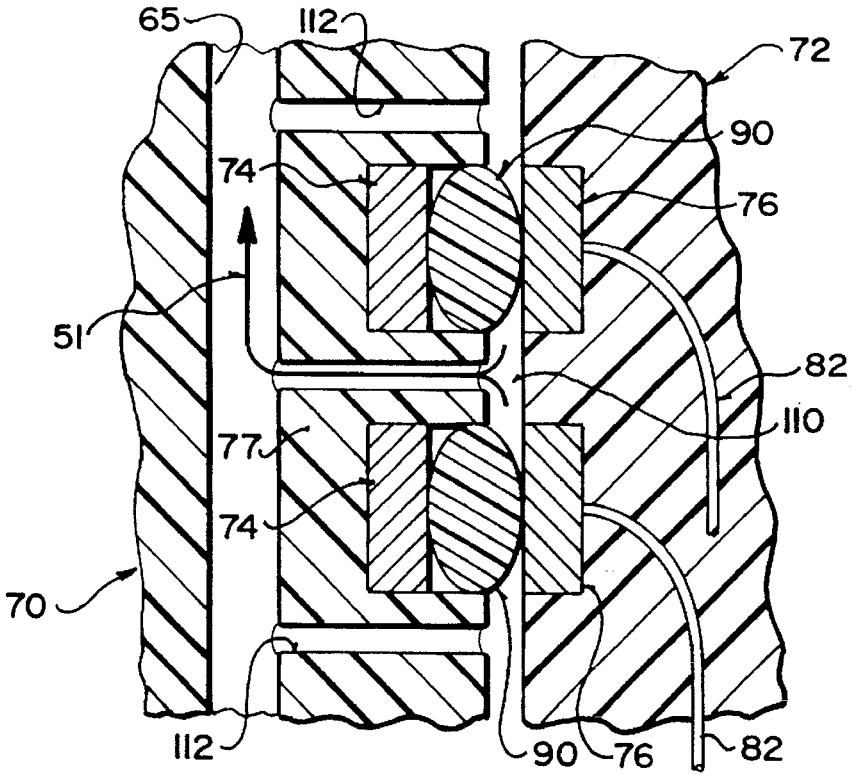
FIG. 2 is a detailed section through one electrical connection in the coupling of FIG. 1.
Figure 3:
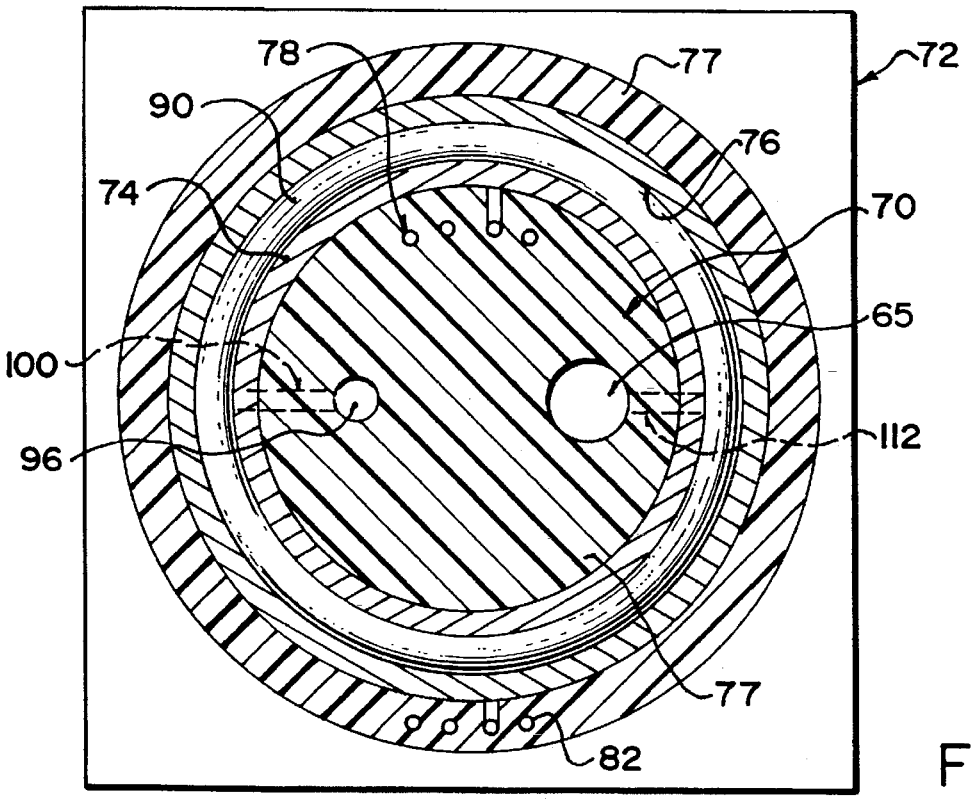
FIG. 3 is a transverse section through the electrical portion of the coupling of FIG. 1.

The construction shown in FIGS. 1, 2 and 3 has several advantages. Some of the advantages are as follows:

(a) It is simpler than previous rotary electrical connectors which require separate springs to maintain a brush in connection with an electrical contact. The resilient nature of o-rings 90 keeps them in contact with rings 74 and 76.

(b) There is a large area of electrical contact between each of rings 74, 76 and o-rings 90. Therefore the electrical connection between rings 74 and rings 76 is not substantially affected by patches of dirt or other contamination on the surface of one of rings 74 or 76.

(c) O-rings 90 extend around drum 70 so that electrical portion 44 is resistant to mechanical shock. Drum 70 is cushioned with respect to housing 72 by o-rings 90 and hydraulic fluid 51. Furthermore, if a mechanical shock is severe enough to cause drum 70 to move slightly laterally inside housing 72 electrical contact between rings 74 and rings 76 is maintained. Any lateral motion of drum 70 inside housing 72 causes the side of rings 74 in the direction of motion to move closer to rings 76 thus increasing the contact pressure between o-rings 90 and rings 74 and 76 on that side of electrical portion 44.

(d) The flow of hydraulic fluid 51 flushes any dirt out of electrical portion 44 and cools electrical portion 44 to the temperature of the circulating hydraulic fluid; and (e) The pressure of hydraulic fluid 51 within electrical portion 44 prevents moisture or dust from entering electrical portion 44.

It will be understood by persons skilled in the art that many modifications and alterations to the embodiments described are possible without departing from the scope of the invention. For example, electrical portion 44 does not need to be used in conjunction with a hydraulic portion 42 but may be used as a stand-alone rotary electrical coupling. The number of pairs of rings 74, 76 may be varied. An electrically non-conductive lubricant other than hydraulic fluid may be used. O-rings 90 do not need to have round cross sections, as illustrated, but may have other cross sectional shapes. While the inventor considers that it is not preferred, o-rings 90 could have internal springs to help to make them resilient instead of being made of solid pieces of conductive elastomer material, as shown. The passages for allowing hydraulic fluid to flush electrical portion 44 may be rearranged.

Electrical portion 44 and hydraulic portion 42 may be completely integrated. Standard seals 56 in hydraulic portion 42 may be replaced or augmented with electrically conductive elastomer o-rings 90 in electrical contact with conductive pads on core 46 and shell 48.

Figure 4:
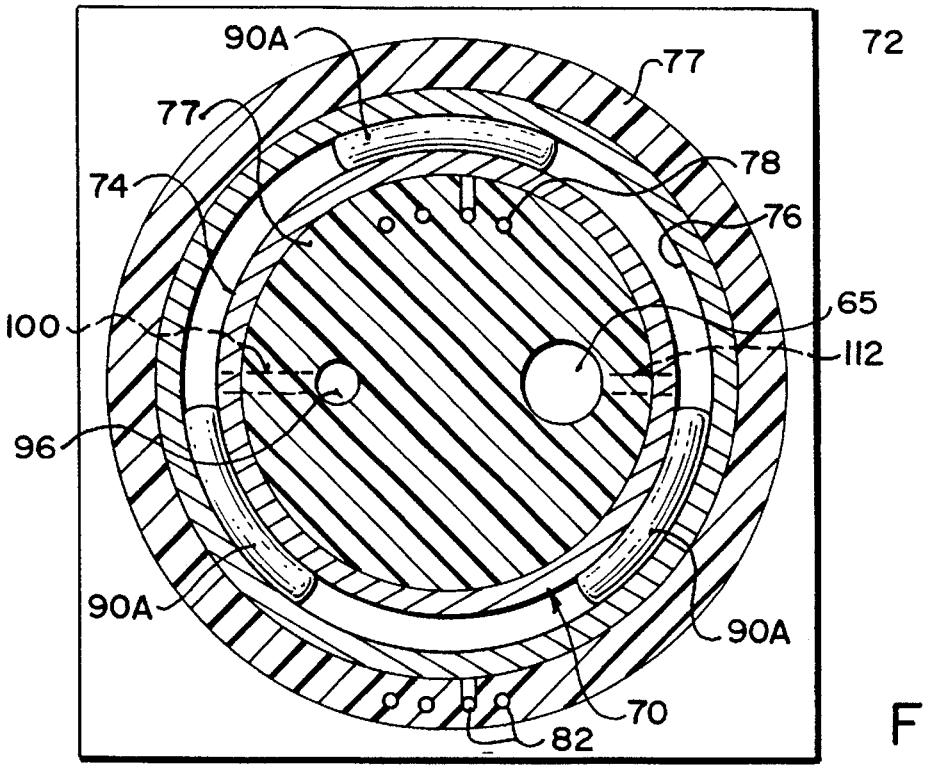
FIG. 4 is a transverse section through an alternative embodiment of the invention.

As shown in FIG. 4, while it is not preferred, O-rings 90 may be replaced by one or more resilient electrically conductive members 90A mounted to one of rings 74, 76. Members 90A may, for example, be sections of the PAR SHIELD MATERIAL NO. S6450 electrically conductive elastomer material described above. Preferably members 90A are distributed around the periphery of rings 74 as shown in FIG. 4.

Figure 5:
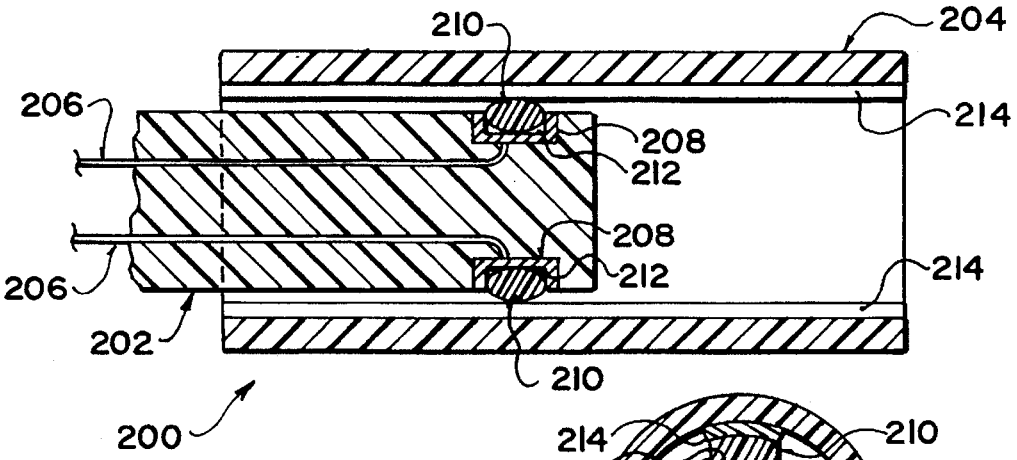
FIG. 5 is a longitudinal elevational section through a sliding electrical coupling according to the invention.
Figure 6:
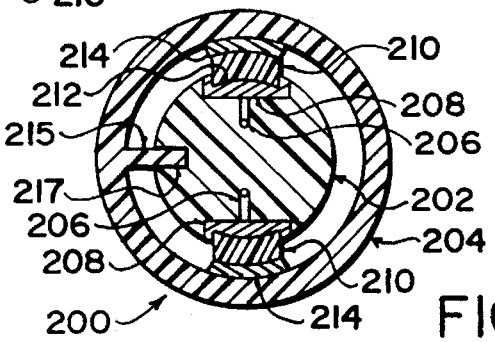
FIG. 6 is a transverse section through the sliding electrical coupling of FIG. 5.

FIG. 5 shows a telescoping electrical coupling 200 according to the invention. coupling 200 comprises a rod 202 which is slidably mounted within a sleeve 204. Wires 206 extend inside rod 202 to electrically conductive pads 208 on the surface of rod 202. A block 210 of a resilient electrically conductive elastomer material lies within an indentation 212 in each pad 208. Blocks 210 are compressed between Rod 202 and electrically conductive strips 214 on the inner surface of sleeve 204. Pads 208 are electrically isolated from each other and from other parts of rod 202. Conductive strips 214 are electrically isolated from each other and from other parts of sleeve 204. Blocks 210 maintain electrical contact between wires 206 and conductive strips 214 as rod 202 slides within sleeve 204. Rod 202 is prevented from rotating inside sleeve 204 by a pin 215 projecting inwardly from sleeve 204 into a keyway 217 in rod 202. As is the case with respect to the embodiment shown in FIGS. 1 and 2, the clearance between rod 202 and sleeve 204 is such that blocks 210 are compressed between pads 208 and conductive strips 214. The resilient nature of blocks 210 maintains each block 210 in contact with its pad 208 and conducting strip 214.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

I claim:

1. A rotary electrical coupling comprising:

(a) a housing;

(b) a member supported for rotation about an axis within a chamber in said housing;

(c) a first smooth electrically conductive ring centered on said axis in said chamber;

(d) a second smooth electrically conductive ring on said rotatable member inside and concentric with said first electrically conductive ring;

(e) an electrically conductive resilient elastomer member extending circumferentially around said second smooth electrically conductive ring and compressed in a gap between said first and second smooth electrically conductive rings; and, (f) an electrically non-conducting lubricant in said chamber.

2. The rotary electrical coupling of claim 1 further comprising a rotary fluid coupling comprising a core mounted for rotation with said rotatable member and an outer shell mounted for rotation with said housing.

3. The rotary electrical coupling of claim 2 wherein said rotary fluid coupling comprises a fluid inlet containing a pressurized electrically insulating lubricating fluid and a fluid outlet containing said electrically insulating lubricating fluid at a reduced pressure, further comprising a first passage extending between said fluid inlet and said chamber and a second passage extending between said chamber and said fluid outlet.

4. The rotary electrical coupling of claim 3 wherein said electrically insulating lubricating fluid consists of a hydraulic fluid.

5. The rotary electrical coupling of claim 1 wherein said electrically non-conductive lubricant within said chamber is pressurized at a pressure greater than an ambient pressure around said rotary electrical coupling.

6. The rotary electrical coupling of claim 1 wherein said resilient elastomer member is in sliding engagement with both of said first and second smooth electrically conductive rings.

7. The rotary electrical coupling of claim 6 wherein said rotatable member comprises a drum having a cylindrical outer surface.

8. The rotary electrical coupling of claim 6 wherein said electrically conductive resilient elastomer member extends into a circumferential groove in said second electrically conductive ring.

9. The rotary electrical coupling of claim 8 wherein said electrically conductive resilient elastomer member comprises an electrically conductive elastomer o-ring.

10. The rotary electrical coupling of claim 7 comprising a plurality of separate electrical connections between a plurality of first conductors on said housing and a plurality of second conductors on said drum, each separate electrical connection comprising: first and second smooth concentric electrically conductive rings and an electrically conductive band of resilient elastomer material compressed in a gap between said first and second electrically conductive rings.

11. The rotary electrical coupling of claim 1 wherein said member is rigidly supported in said chamber by a bearing.

12. A hydraulically operated machine comprising:

(a) a first member pivotally mounted to a second member;

(b) a first electrical conductor on said first member connected to a second electrical conductor on said second member by a rotary electrical coupling, said rotary electrical coupling comprising:

(i) spaced apart inner and outer concentric rings rotatable relative to each other about a common axis, said inner and outer concentric rings each mounted for rotation with a different one of said first and second members;

(ii) first and second electrically conductive regions on said inner and outer concentric rings respectively and electrically connected to said first and second electrical conductors respectively; and (iii) a resilient conductive elastomer ring extending circumferentially around said inner ring, compressed between said inner and outer rings, and in electrical connection with both of said first and second electrically conductive regions; and, (iv) a substantially non-electrically-conducting lubricant on said elastomer ring;

(c) a means for generating electrical control signals electrically connected to said first conductor; and (d) a means for operating a hydraulic valve in response to said control signals electrically connected to said second conductor.

13. The machine of claim 12 wherein each of said inner and outer concentric rings comprises one or more electrically connected electrically conductive regions extending substantially entirely circumferentially.

14. The machine of claim 13 wherein said rotary electrical coupling is in a sealed cavity in a housing and said cavity is substantially filled with said lubricant, wherein said lubricant is pressurized to a pressure greater than an ambient pressure outside of said cavity.

* * * * *